US008468892B2

(12) United States Patent
Herzog et al.

(10) Patent No.: US 8,468,892 B2
(45) Date of Patent: Jun. 25, 2013

(54) ULTRASONIC SENSOR FOR DETECTING AND/OR SCANNING OBJECTS

(75) Inventors: Thomas Herzog, Dresden (DE); Henning Heuer, Dresden (DE)

(73) Assignee: Fraunhofer-Gesellschaft zur Foerderung der Angerwandten Forschung E.V., München (DE)

( * ) Notice: Subject to any disclaimer, the term of this patent is extended or adjusted under 35 U.S.C. 154(b) by 364 days.

(21) Appl. No.: 12/987,514

(22) Filed: Jan. 10, 2011

(65) Prior Publication Data

US 2012/0013222 A1 Jan. 19, 2012

(30) Foreign Application Priority Data

Jan. 19, 2010 (EP) ..... 10000489

(51) Int. Cl.
*G01N 29/00* (2006.01)

(52) U.S. Cl.
USPC ..... 73/649; 73/598; 73/602

(58) Field of Classification Search
USPC ..... 73/649, 579, 598, 599, 602
See application file for complete search history.

(56) References Cited

U.S. PATENT DOCUMENTS

| | | | | |
|---|---|---|---|---|
| 3,826,866 | A * | 7/1974 | Quate et al. | 348/198 |
| 4,084,192 | A * | 4/1978 | Defranould et al. | 348/198 |
| 4,435,984 | A * | 3/1984 | Gruber | 73/628 |
| 5,589,636 | A * | 12/1996 | Bicz | 73/617 |
| 6,942,619 | B2 * | 9/2005 | Toda | 600/459 |

FOREIGN PATENT DOCUMENTS

| | | |
|---|---|---|
| EP | 0 128 049 | 12/1984 |
| JP | 60-012899 | 1/1985 |
| JP | 02-216007 | 8/1990 |

* cited by examiner

*Primary Examiner* — J M Saint Surin
(74) *Attorney, Agent, or Firm* — Fay Kaplun & Marcin, LLP

(57) ABSTRACT

An ultrasonic sensor for detecting and/or scanning an object includes a substrate and a piezoelectric sensor unit arranged on or at this substrate and/or connected to this substrate. The rear side of the substrate facing away from the piezoelectric sensor unit has a surface structure including a plurality of elevated portions and recesses, with this surface structure being configured so that a diffuse scattering of ultrasonic waves incident on the rear side from the direction of the sensor unit takes place by it; and/or in that its elevated portions and/or recesses have a mean lateral extent in the range of 0.05 μm to 1 mm, preferably from 0.1 μm to 200 μm, preferably from 0.2 μm to 20 μm, and/or a mean lateral extent which is smaller than or equal to the wavelength of an ultrasonic wave which can be produced by the piezoelectric sensor unit.

23 Claims, 2 Drawing Sheets

ULTRASONIC SENSOR FOR DETECTING AND/OR SCANNING OBJECTS

PRIORITY CLAIM

This application claims priority to EP Patent Application No. 10 000 489.4 filed on Jan. 19, 2010 and which is expressly incorporated herein, in its entirety, by reference.

FIELD OF INVENTION

The present invention relates to an ultrasonic sensor for detecting and/or scanning objects as well as to a manufacturing method for such an ultrasonic sensor.

BACKGROUND INFORMATION

On the use of active piezoelectric thin films such as thin films of AlN or ZnO for ultrasonic sensors, said thin films are usually directly deposited onto suitable carrier materials or carrier substrates such as silicon, sapphire, gallium nitride, etc. If these thin films with their carrier materials should be used as ultrasonic sensors, the propagation of the ultrasonic waves into the coupled medium (to be detected and/or to be measured) (it will alternatively also be called an object in the following) and the echo resulting therefrom reflected by a barrier layer in the medium or object has to be evaluated.

Since, however, ultrasonic waves simultaneously propagate in the carrier substrate on the measurement, disturbing echoes can be produced by reflections at the barrier layer between the carrier substrate rear side and the adjacent medium (e.g. air) which are then (like the echoes produced in the actual measured object) detected by the sensor unit. Such echoes are thus to be avoided in the interest of a measuring accuracy which is as high as possible.

For this purpose, it is known from the prior art to deposit the piezoelectric thin films directly onto the measured object by means of a semiconductor process, with the surrounding air then suppressing the echoes as a rear-side layer. It is known, alternatively to this, to design the thickness of the carrier substrates of the sensor so that the echoes are only again incident at the piezoelectric layer of the sensor from the rear side of said carrier substrates (that is from the barrier layer between the carrier rear side and the adjacent medium) when the useful echo from the medium or object coupled to the front site has already been registered. It is finally also known from the prior art to cover the piezoelectric oscillators of ultrasonic heads by impedance-adjusted, e.g. block-shaped damping bodies, so that the ultrasonic waves are absorbed in these separate damping bodies to prevent the disturbing echoes by means of the damping body.

SUMMARY OF INVENTION

The present invention relates to an ultrasonic sensor (as well as a corresponding manufacturing method) with which the previously described disturbing echoes can be suppressed as best as possible up to completely by the barrier layer between the carrier rear side and the adjacent medium and which nevertheless allows a construction shape which is as simple as possible, compact, in particular also suitable for the use of active piezoelectric thin films and application possibilities which are as flexible as possible.

The present invention will initially be described generally in the following, then specifically in the form of an embodiment. The individual, optionally also advantageous, features of the present invention realized in combination in the embodiment in this respect do not have to be realized precisely in the shown combination, but can also be realized in different combinations within the framework of the invention or of the claims. Individual features of the embodiments can in particular also be omitted.

The present invention relates to designing the previously described rear side surface of the carrier substance (also called a substrate in simplified terms in the following) of the ultrasonic sensor so that no disturbing echoes of the barrier layer between the carrier substrate rear side and the adjacent medium move back up to the piezoelectric sensor layer or up to the sensor unit of the ultrasonic sensor. This is done by forming the rear side of the substrate such that a plurality of elevated portions and recesses can be introduced into this rear side, that is, such that a corresponding surface structuring of the substrate rear side takes place. The substrate can naturally also include a plurality of layers so that in this case a surface structuring of the rear side of the substrate layer furthest remote from the sensor unit takes place. (However, when necessary due to the material selection, a plurality of surfaces or barrier layers of a multilayer substrate can be surface-structured or depth-structured).

The surface or rear side of the substrate to be structured in this manner can in particular be configured in the form of black silicon. It is, however, also equally possible when sapphire or gallium nitride are used as the substrate material to apply corresponding depth structuring to their rear sides.

If it is spoken of within the framework of the present invention and of the following description that an element (e.g. the piezoelectric sensor unit) is arranged on or at another element (e.g. substrate) and/or is connected to this other element, this does not exclude the fact that one or more further elements (e.g. passivation layers, protective layers, or similar) are located between the two elements. A diffuse scattering is understood within the framework of the invention as a scattering of ultrasonic waves which is configured such that, after the scattering has taken place, a directed propagation of the ultrasonic waves in a preferred direction no longer takes place, but rather a further propagation of the ultrasonic energy in the most varied directions so that no echo (or only a slight echo) by the scattered ultrasonic waves can be detected by the sensor unit.

A lateral direction is understood as a direction within the layer plane of the ultrasonic sensor and/or its sensor unit. The direction perpendicular thereto, that is, the direction perpendicular to the sensor plane and/or to the plane of the substrate (e.g. wafer) will in the following alternatively also be called a depth direction or a vertical direction. If in the following a mean extent (e.g. a mean lateral extent, that is, an extent in the direction of the layer plane of the sensor or of a mean vertical extent of the elevated portions in the direction perpendicular to the layer plane) is spoken of, the corresponding mean is to be understood as the arithmetic mean from a plurality of individual values (e.g. of lateral extents of individual needle-shaped elevated portions).

An ultrasonic sensor in accordance with the invention includes a substrate and a piezoelectric sensor unit arranged on or at this substrate and/or connected to this substrate. The rear side of the substrate remote from the piezoelectric sensor unit has a plurality of elevated portions and recesses; a surface structure is thus introduced in this rear side. The surface structuring or surface structure is configured so that a diffuse scattering of the ultrasonic waves incident onto the structured rear surface from the direction of the sensor unit (that is, from the front side of the sensor) takes place by it. The elevated portions and/or recesses can have a mean lateral extent in the range from 0.05 μm to 1 mm, preferably in the range from 0.1

μm to 200 μm and particularly preferably in the range from 0.2 μm to 20 μm. This mean lateral extent can thus be smaller than or equal to the wavelength of an ultrasonic wave which can be produced (on the front side of the substrate) by the piezoelectric sensor unit.

The piezoelectric sensor unit attached to the front side of the substrate can be configured to transmit and/or to receive ultrasonic waves in accordance with a frequency of the range from 20 kHz to 1 GHz. The piezoelectric sensor unit can in this respect also be made up of a plurality of sub-units configured to receive or to transmit ultrasound. Corresponding embodiments as well as evaluation algorithms for evaluating the transmitted and/or received ultrasonic signals are in this respect familiar to the skilled person (for example, corresponding embodiments can be seen from DE 10 2006 005 048 A1).

The surface structure structured in the rear side of the substrate can be configured for the diffuse scattering of ultrasonic waves in accordance with the aforesaid frequency range.

The substrate is preferably silicon, in particular crystalline silicon. The substrate can be a silicon wafer. It is, however, equally also conceivable to use sapphire or gallium nitride as the substrate.

In the case of silicon as the substrate, the rear side and/or its surface structure is preferably configured in the form of black silicon. A surface modification of the crystalline silicon is understood as follows as black silicon within the framework of the present invention: The crystalline silicon is, for example, structured by ultrashort laser pulses or by the bombardment of the silicon surface with high-energy ions of the substrate rear side so that structures (elevated portions and recesses) are produced on the surface which preferably have a photo-optical effect and are preferably of needle shape.

The needle-shaped recesses and elevated portions in the silicon can be manufactured with deep reactive ion etching known to the skilled person. The deep ion etching process is a two-stage, alternating dry etching process in which an etching step and a passivation step alternate. It is the aim to etch in as anisotropic a manner as possible, i.e., in dependence on the direction, perpendicular to the wafer surface. After a masking of regions on the silicon to be protected, e.g. by means of aluminum, sulfur hexafluoride (SF6) and a carrier gas (usually argon) are introduced into the reactor having the substrate located therein. After the supply of electric energy (e.g. inductively coupled plasma, ICP, or by means of microwave electron cyclotron resonance), a high-energy radio frequency plasma forms, with a reactive gas arising from the SF6 ($SF6^+$ ions, activated SF6 molecules as radicals containing fluorine and oxygen radicals arise in the plasma). Together with the acceleration of the argon ions in an electric field, a chemical etching reaction (isotropic) is superimposed on the substrate and a physical (anisotropic) material removal is superimposed by means of argon ions. Depending on the plant type, the process takes place at low pressures from 50 Pa to 1 Pa, preferably in an RF plasma with 13.65 MHz, pressure range 10-50 Pa.

The etching process is stopped after a short time and a gas mixture of octafluorocyclobutane (C4F8) and argon is introduced. The octafluorocyclobutane is activated as a plasma gas in the reactor and the arising radicals containing fluorine and molecules form a polymer-like passivation layer over the total substrate, i.e. both over the mask and over the silicon and the vertical silicon side walls. The passivation layer of the horizontal surfaces (trench base) is removed a lot faster by the directed physical component (ions) of the etching reaction than the layer at the side walls due to the subsequently repeated etching step with SF6.

Long silicon columns can remain in place using this method in accordance with the invention by the deposition from above and the polymer from the sides. The process can in this process be set so that millions of needles can form over a square millimeter.

It is also familiar to the skilled person that silicon in the vacuum recipient filled with halogen gas changes its spatial structure by high energy inputs such that black silicon arises due to bombardment of the silicon surface with extremely high-energy pulsed femtosecond lasers (lasers which transmit light pulses whose duration is in the femtosecond range (1 fs=$10^{-15}$ s with peak energies in the gigawatt or terrawatt range). A needle-shaped surface can also be manufactured in accordance with the invention by the laser bombardment (several hundred pulses).

The "black" structures produced in the silicon preferably have a length (perpendicular to the substrate plane) of a few up to >10 μm with a diameter of approximately 1 μm or less on monocrystalline silicon so that the structure is also called "silicon grass" or "RIE grass".

(DRIE=deep reactive ion etching). One main feature of such a layer of black silicon on the rear side of the substrate is an increased absorption of incident visible light which is effected by the formation of the aforesaid deep structure or surface structure (the deep structure effects a constant transition of the refractive index of the effective medium so that no sharp optical boundary surface exists at which the light can be reflected; instead, the light is "gently" directed into the material and hardly reflected, which makes the silicon appear black).

The elevated portions and recesses of the surface structure (also with other substrates) can thus be manufactured by laser bombardment, by ion bombardment, in particular by reactive ion etching or deep reactive ion etching and/or also by micromechanical, material removing machining of the rear side of the substrate. As described above, the elevated portions are preferably configured in needle shape.

The mean height of the elevated portions, the mean depth of the recesses and/or the mean extent of the elevated portions and/or of the recesses perpendicular to the sensor plane (in the following also designated by the variable A) is preferably in the range between 0.05 μm and 1 mm, preferable in the range between 0.1 μm and 200 μm, and particularly preferably in the range from 0.1 μm to 20 μm (that is, ultimately in the same order of magnitude as the lateral extent of the elevated portions and/or recesses in the sensor plane). The aspect ratio a=A/L of the aforesaid height, depth and/or extent and of the mean lateral extent of the elevated portions and/or recesses (which is also designated by the variable L in the following) thus preferably amounts to between 0.2 and 50, particularly preferably between 0.5 and 10.

The piezoelectric element of the piezoelectric sensor unit is preferably configured in the form of a piezoelectric thin film. This layer can comprise AlN or ZnO or include this material. The sensor unit preferably has a layer thickness in the range between 1 μm and 100 μm, preferably between 10 μm and 25 μm. The sensor unit can, as previously described, also comprise a plurality of sub-units which are distributed over the layer plane and which each have corresponding thin film elements.

To excite the piezoelectric element or the piezoelectric thin film to oscillations and/or to measure the electric voltage generated in the piezoelectric element or in the thin film by mechanical pressure, the piezoelectric sensor unit (or, if there are a plurality of sub-units, each of said sub-units) has two electrical contacts connected to the piezoelement to detect and/or apply the electric voltage. The piezoelectric thin film is in this respect preferably arranged in the manner of a sandwich between these two electrical contacts and is directly adjacent to these electrical contacts. The electrical contacts can, for example, be formed from copper.

The piezoelectric sensor unit or the corresponding sub-sensor units can be configured for transmitting ultrasonic waves, for receiving ultrasonic waves or also in combination for transmitting and for receiving ultrasonic waves (transmission and reception unit). In order e.g. to allow a free oscillation of the sensor unit and/or of the sub-units, the substrate with the sensor unit(s) formed thereon can be configured as a thin membrane.

The ultrasonic sensor can be configured in the form of an ultrasonic test head or can be integrated into such a test head.

In accordance with the invention, an acoustically highly scattering rear side of the substrate is realized for active piezoelectric thin films which are deposited on suitable carrier materials (in particular: silicon). This can in particular be realized via the black silicon technology by means of ion etching, by structuring by means of laser machining or by material-removing processes such as wafer sawing. The procedure in the individual machining processes is generally known to the skilled person, for example as follows:

Silicon Etching:

1. F. Lärmer, A. Schilp: Method of anisotropic etching of silicon, Patent DE 4241045, Germany, applied for on Dec. 5, 1992, granted on May 26, 1994.
2. W. Menz, J. Mohr: Microsystem technology for engineers, VCH-Verlag, Weinheim 1997, ISBN 352730536X.
3. Gary S. May, Simon M. Sze: Fundamentals of Semiconductor Fabrication, Wiley & Sons, 2003, ISBN 0-47145238-6.
4. Kanechika M., Sugimoto N., Mitsushima Y., Control of shape of silicon needles fabricated by highly selective anisotropic dry etching, Jour of Vacuum Science & Technology B: Microelectronics and Nanometer Structures—July 2002—Vol. 20, I. 4, pp. 1298-1302.
5. H. V. Jansen et al, the black silicon method: a universal method for determining the parameter setting of a fluorine based reactive ion etcher in deep silicon trench etching with profile control, Journal of Micromechanical Microengineering 5 (1995), pp. 115-120.

Laser Machining

6. Fritz Kurt Kneubühl, Markus Werner Sigrist: Laser, 6th Edition, Teubner, Wiesbaden 2005, ISBN 3-8351-0032-7.
7. J. Eichler, H. J. Eichler: Lasers, Construction forms, Jet guidance, Applications, 5th Edition, Springer-Verlag, ISBN 3-540-00376-2.

Silicon Microengineering Micromechanics

8. Ulrich Hilleringmann: Microsystem engineering Process steps, Technologies, Applications, 1st Edition, Vieweg+ Teubner, 2006, ISBN 3-835-10003-3.
9. Brück, Rainer [Editor] Bauer, Hans-Dieter: Applied microengineering; LIGA, Lasers, Precision engineering/ Munich; Vienna; Hanser, 2001—ISBN 3-446-21471-2.

The manufacture of a substrate having an ultrasound scattering rear side ("substrate absorber layer") can consequently takes place for piezoelectric thin film sensor units such that the substrate (for example the silicon wafer) is first provided with a corresponding surface structure (e.g. a surface from black silicon) on the rear side before the coating processes (coating with the thin piezoelectric layer and with corresponding electrical contacts). This can take place as previously described by laser pulses or reactive ion etching. The coating with the piezoelectric sensor layer and the electrodes is generally known to the skilled person in this respect; for example, cathode sputtering processes can be used as coating processes. Theoretically, all PVD processes such as RF sputtering can be used with pulse magnetron sputter processes being preferably suitable. See in this regard, for example:

10. Leyens, Christoph: Interaction between manufacturing parameters and layer properties of selected metal and ceramic systems in magnetron cathode sputtering/Düsseldorf: VDI-Verl., 1998. (Progress reports VDI: Series 5, Basic materials, work materials, plastics; 534) ISBN 3-18-353405-3.
11. U. Krause: The behavior of the electric parameters in bipolar pulse magnetron sputtering for the example of tin oxide and zinc oxide, 2002, Hochschulschrift Magdeburg, Univ., Diss., 2001.
12. D. Glöss, Influence of coating parameters on the particle and energy flow to the substrate and effects on selected properties of titanium oxide layers in reactive pulse magnetron sputtering, Diss. Faculty for Natural Sciences of Chemnitz Technical University, 2006.
13. D. Depla: Reactive sputter deposition; Berlin, Heidelberg [inter alia]: Springer, 2008 (Springer series a in materials science, 109) ISBN 978-3-540-76662-9.

In accordance with the invention, trenches, recesses, pits, can be structured into the rear side of the substrate as elevated portions and recesses by reactive ion etching, for example. The recesses can, for example, have a depth of a several 100 μm and can be produced with a high aspect ratio (e.g. in the range of 2 to 50). This can be achieved by repeated alternating of etching and passivation of the rear-side substrate surface. During etching, however, small deposits of the passivation can remain on the base and mask it. On a transposition of the process toward passivation, structures thus arise which are to be shaped and which are also not removed in the following etching steps.

Perpendicular (relative to the substrate plane) surfaces hereby arise at which a polymer layer can be deposited. Elevated portions can thus remain, for example in the form of elongate silicon columns, masked by the deposition from above and masked by the polymer at the sides. The reactive ion etching can in this respect be set so that millions of small needles can form columns on 1 $mm^2$. The spatial structure of the rear side of the substrate can also be modified by bombardment with extremely high-energy pulsed femtosecond lasering so that a needle-like deep structured surface arises (e.g. needles of a mean length of 300 nm). The processes can be reproduced comparatively easily and uniformly.

BRIEF DESCRIPTION OF DRAWINGS

The invention will be described in the following with reference to an embodiment.

There are shown.

DETAILED DESCRIPTION

Figure 1:
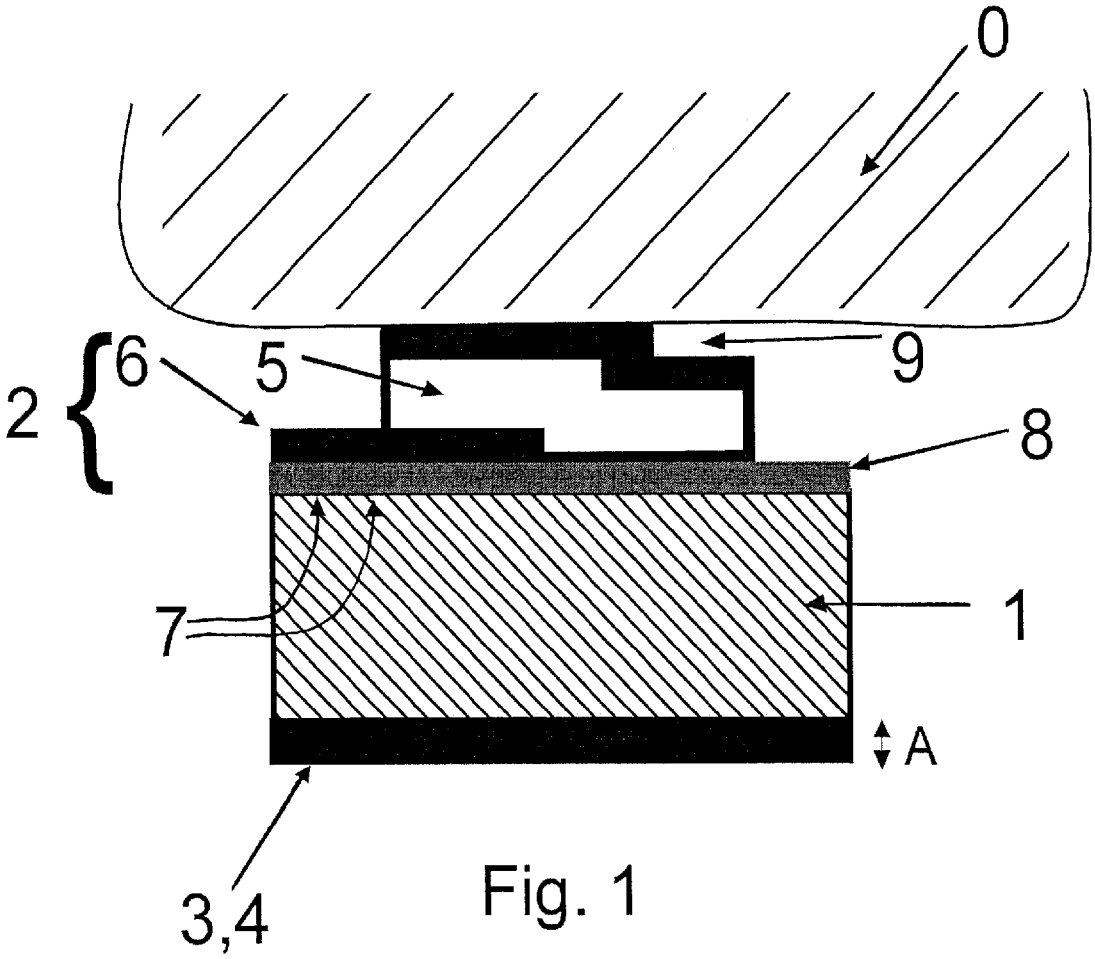
FIG. 1 a section perpendicular to the substrate plane through an ultrasonic sensor in accordance with the invention (schematic drawing)

FIG. 1 shows a section through an ultrasonic sensor in accordance with the invention. As previously described, the rear side 3 of a monocrystalline silicon wafer 1 is provided by deep reactive ion etching with a surface structure 4 including a plurality of needle-shaped elevated portions and recesses (cf. FIG. 2). The thickness of the wafer 1 here amounts to 500 μm, the depth of the recesses or the extent of the individual needle-shaped elevated portions A of the surface structure 4 on the rear side 3 of the substrate 1, that is, the depth of the structures in the black silicon on the rear side 3 of the wager 1, here amounts to 2 to 5 μm and the lateral extent of these elevated portions (cf. FIG. 2) here amounts to 200 to 800 nm.

The individual elements of the electric sensor unit 2 are subsequently applied to the front side 7 of the wafer opposite the rear side 3 with the aid of a magnetron sputtering process. First, however an insulation layer 8 of silicon oxide, here 1 to 2 μm thick, is deposited on the front side 7 of the wafer 1. A first electrode metallization or electrode layer 6 (here a 150 μm thick aluminum layer) is first applied to this electrical insulation layer 8. A piezoelectrically active thin film (piezoelectric layer 5) of AlN is coated on this first electrode metallization 6. Alternatively to this, ZnO can, for example, also be used as the layer material. The piezoelectric thin film here has a layer thickness of 5 to 25 μm. Finally, the second electrical contact 9 of the piezoelectric thin film 5 is coated on the side of the piezoelectric layer 5 opposite the first metallization 6. This contact is also an aluminum layer contact whose thickness corresponds to the thickness of the first metal contact 6. The sensor unit 2 here includes the elements 5, 6 and 9 (and, depending on the perception, the layer 8).

The following layer structure thus results viewed from the rear side 3 having the surface structure 4 of the ultrasonic sensor toward the front side (electrical contact 9): Rear side 3 having surface structure 4, silicon wafer 1, insulation layer 8, first metal contact 6, piezoelectrically active thin film 5 and second metal contact 9.

The sensor 1 to 9 shown can thus be set onto an external object O which should be scanned or measured. Ultrasonic waves can be generated and coupled into the object O in the piezoelectric sensor unit 2 of the ultrasonic sensor which is shown as a combined transmission/reception unit (the detailed structure of said ultrasonic sensor is e.g. known to the skilled person in accordance with DE 10 2006 005 048 A1). The ultrasonic waves are reflected at boundary surfaces in the object and the corresponding echo signals are detected and evaluated by the sensor unit 2. The coupling of ultrasonic energy or of ultrasonic waves into the substrate carrier 1 taking place simultaneously with the coupling of ultrasonic waves or of ultrasonic energy into the object O does not result in measurable echoes (non-directed backscatter of the ultrasonic waves reflected at the surface 3) due to the diffuse reflection of these waves at the deep structured 4 rear side 3 of the carrier substrate 1. Disturbing echo signals are thus avoided by the shown ultrasonic sensor 1 to 9 and the measurement precision on the scanning of the object O is increased.

Figure 2:
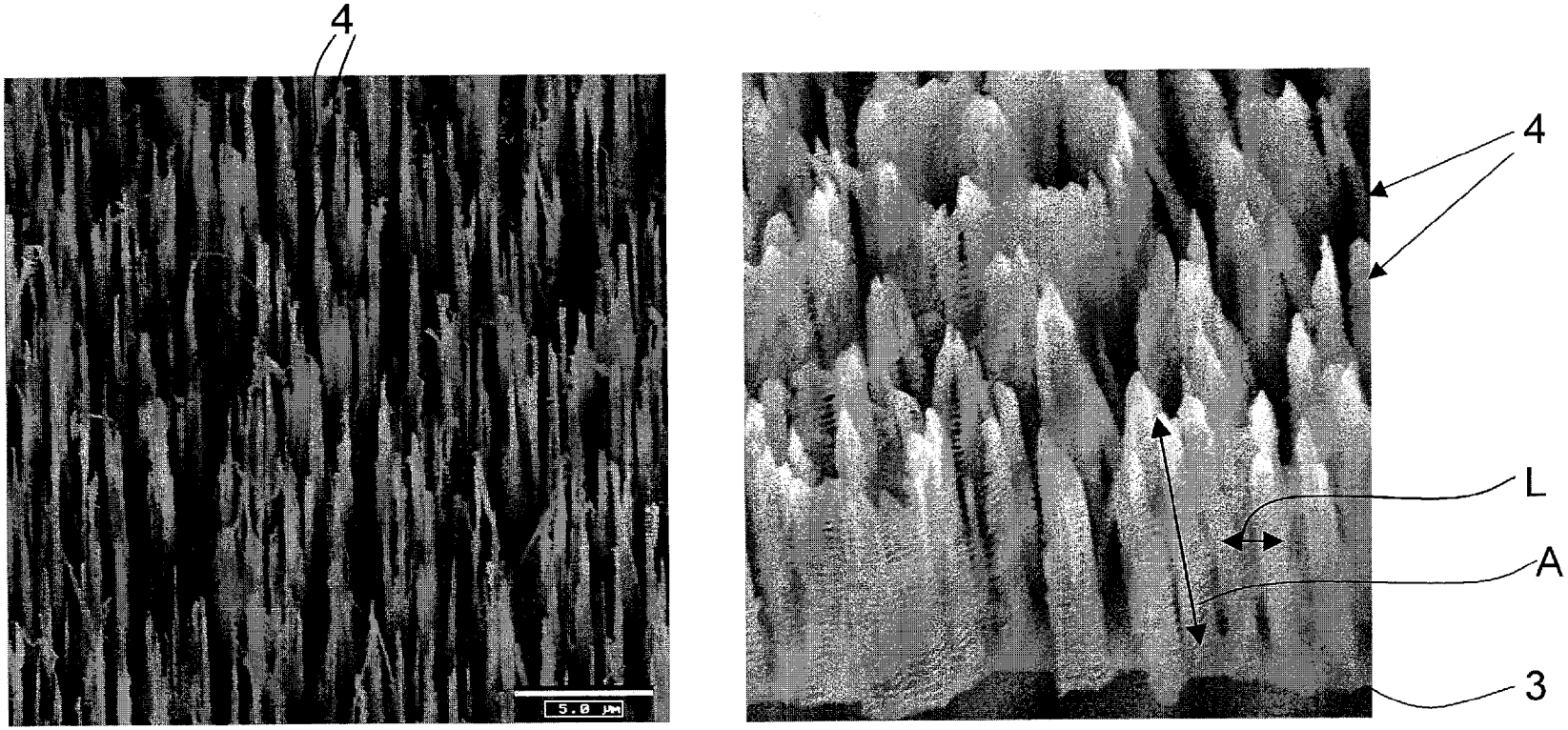
FIG. 2 an electron microscope image of a surface structure of the rear side of a silicon wafer (black silicon) used in the sensor in accordance with FIG. 1.

FIG. 2 shows an example for a rear side 3 or a surface structure 4 of this side for an ultrasonic sensor sketched in FIG. 1 in an electron microscope image: FIG. 2, left, shows an electron microscope image at an enlargement of 10,000, whereas FIG. 2, right, shows a high magnification (magnification factor 50,000). The individual needle-shaped elevated portions and the individual silicon needles of the black silicon formed at the rear side 3 of the silicon wafer 1 can easily be recognized. The mean lateral spacing L of two silicon needles here amounts to approx. 2 to 5 μm; the mean height A here amounts to 10 to 20 μm, this corresponds to approx. 2 million needles per square millimeter.

In the structure of a silicon absorber layer 1, 3, 4 for a piezoelectric sensor unit 2 or 2, 8 (the insulation layer 8 can be considered a part of the sensor unit 2), a layer of black silicon is thus applied to the silicon substrate 1 by means of the previously described processes on the lower side or on the rear side 3. The manufacturing process for the piezoelectric thin film sensor unit 2, 8 then takes place on the upper side or front side 7 of the silicon wafer 1: After the application of the insulation layer 8 of silicon oxide, the first thin film electrode metallization 6 is applied, followed by the active piezoelectric material 5. Finally, the application of the second thin film electrode metallization 9 takes place.

It is thus possible with the present invention to scatter the disturbing ultrasound echoes from the carrier substrate 1 for the layer sensor elements 2 so that they do not have any large influence on the echo which returns from the medium or object O coupled to the active surface (front side of the ultrasonic sensor). Much broader application fields for piezoelectric ultrasonic thin film sensors are thus possible. Since the sensor no longer has to be applied directly to the measured object, since air does not necessarily have to be realized as the rear side boundary layer and since very thick carrier substrates no longer have to be used, radio frequency ultrasonic test heads can easily be manufactured using the present invention.

A substantial core of the invention is thus the manufacture of the electroacoustic absorber layer on the rear side of a carrier substrate by a heavily fissured surface having structure widths of, for example, less than 1 μm and having structure depths of, for example, several 100 nm, with a piezoelectric sensor unit in thin film technology then lying on the oppositely disposed front side or surface.

Ultrasonic sensors or thin film ultrasonic sensors in accordance with the invention can be realized in destruction-free material testing of thin films, quality assurance, in process monitoring or also very generally for any desired ultrasonic sensor work. Radio frequency ultrasonic test heads can in particular also be realized in accordance with the invention.

The invention claimed is:

1. An ultrasonic sensor for at least one of detecting and scanning an object, comprising:

a substrate; and a piezoelectric sensor unit at least one of (a) arranged on or at the substrate and (b) connected to the substrate, wherein a rear side of the substrate facing away from the sensor unit has a surface structure including a plurality of elevated portions and recesses, wherein the surface structure is configured so that both (a) a diffuse scattering of ultrasonic waves incident on the rear side from a direction of the sensor unit is effected by it and (b) the elevated portions and/or recesses have a mean lateral extent at least one of (1) in a range between 0.05 μm and 1 mm and (2) which is smaller than or equal to a wavelength of an ultrasonic wave which can be produced by the sensor unit.

2. The ultrasonic sensor of claim of 1, wherein the mean lateral extent is in a range between 0.1 μm and 200 μm.

3. The ultrasonic sensor of claim of 1, wherein the mean lateral extent is in a range between from 0.2 μm and 20 μm.

4. The ultrasonic sensor of claim of 1, wherein at least one of (a) the sensor unit is configured for at least one of transmitting and receiving of and (b) the surface structure is configured for the diffuse scattering of ultrasonic waves in accordance with a frequency in a range between 20 kHz and 1 Ghz.

5. The ultrasonic sensor of claim of 1, wherein the substrate includes silicon.

6. The ultrasonic sensor of claim of 1, wherein the substrate includes crystalline silicon.

7. The ultrasonic sensor of claim of 1, wherein the substrate is a silicon wafer.

8. The ultrasonic sensor of claim of 1, wherein the substrate includes one of sapphire and gallium nitride.

9. The ultrasonic sensor of claim of 1, wherein at least one of the rear side and the surface structure includes black silicon.

10. The ultrasonic sensor of claim of 1, wherein the elevated portions and recesses are manufactured by at least one of a laser bombardment, an ion bombardment, a reactive ion etching, a deep reactive ion etching, a mechanical material-removing machining of the rear side of the substrate.

11. The ultrasonic sensor of claim of 10, wherein the elevated portions are configured in a needle shape.

12. The ultrasonic sensor of claim of 1, wherein at least one of a mean height of the elevated portions, a mean depth of the recesses and a mean extent of the elevated portions and/or recesses perpendicular to the sensor plane is in the range between 0.05 μm and 1 mm.

13. The ultrasonic sensor of claim of 1, wherein at least one of a mean height of the elevated portions, a mean depth of the recesses and a mean extent of the elevated portions and/or recesses perpendicular to the sensor plane is in the range between 0.1 μm and 200 μm.

14. The ultrasonic sensor of claim of 1, wherein at least one of a mean height of the elevated portions, a mean depth of the recesses and a mean extent of the elevated portions and/or recesses perpendicular to the sensor plane is in the range between 0.2 μm and 20 μm.

15. The ultrasonic sensor of claim of 1, wherein an aspect ratio a=A/L is between 0.2 and 50 and wherein A is at least one of a mean height of the elevated portions, a mean depth of the recesses and a mean extent of the elevated portions and/or recesses perpendicular to the sensor plane and L is the mean lateral extent of the elevated portions and/or recesses.

16. The ultrasonic sensor of claim of 1, wherein the sensor unit includes at least one piezoelement.

17. The ultrasonic sensor of claim of 16, wherein the at least one piezoelement is a piezoelectric thin film at least one of (a) having a layer thickness in a range between 1 μm and 100 μm and (b) made of one of AlN and ZnO.

18. The ultrasonic sensor of claim of 16, wherein the at least one piezoelement is a piezoelectric thin film at least one of (a) having a layer thickness in a range between 10 μm and 25 μm and (b) made of one of AlN and ZnO.

19. The ultrasonic sensor of claim of 1, wherein the sensor unit includes at least one piezoelectric element and at least two electrical contacts connected to the piezoelectric element for at least one of (a) detecting an electric voltage occurring in the piezoelectric element due to an external pressure and (b) application of an electrical voltage to the piezoelectric element.

20. The ultrasonic sensor of claim of 19, wherein at least one of the piezoelectric elements is arranged between the at least two electrical contacts connected thereto.

21. The ultrasonic sensor of claim of 1, wherein the sensor unit is configured as one of (a) a transmission unit for transmitting ultrasonic waves, (b) a reception unit for receiving ultrasonic waves and (c) a transmission and reception unit for transmitting and receiving ultrasonic waves.

22. The ultrasonic sensor of claim of 1, wherein the sensor unit is configured together with the substrate at least sectionally as a membrane.

23. The ultrasonic sensor of claim of 1, wherein the sensor at least one of (a) includes a plurality of piezoelectric sensor units and (b) is an ultrasonic test head.

* * * * *